US006615018B2

(12) United States Patent
Funato

(10) Patent No.: US 6,615,018 B2
(45) Date of Patent: Sep. 2, 2003

(54) IMAGE FORMING APPARATUS AND FIXING UNIT USED THEREFOR

(75) Inventor: Hitoshi Funato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/994,748

(22) Filed: Nov. 28, 2001

(65) Prior Publication Data

US 2002/0191992 A1 Dec. 19, 2002

(30) Foreign Application Priority Data

Jun. 18, 2001 (JP) ..... 2001-183121

(51) Int. Cl.[7] ..... G03G 15/20; G03G 15/00

(52) U.S. Cl. ..... 399/322; 399/328; 399/400; 399/401

(58) Field of Search ..... 399/68, 320, 322, 399/328, 329, 341, 400, 401, 405

(56) References Cited

U.S. PATENT DOCUMENTS 4,928,148 A * 5/1990 Higashi ..... 399/328 X
5,296,904 A * 3/1994 Jackson ..... 399/328
5,434,029 A * 7/1995 Moser ..... 399/328 X
5,436,711 A * 7/1995 Hauser ..... 399/328
5,887,234 A * 3/1999 Aslam et al. ..... 399/322
5,890,032 A * 3/1999 Aslam et al. ..... 399/329 X
6,269,237 B1 * 7/2001 Olbrich et al. ..... 399/401

FOREIGN PATENT DOCUMENTS

JP A 10-123863 5/1998
JP A 2000-221834 8/2000

* cited by examiner

*Primary Examiner*—Sandra Brase
(74) *Attorney, Agent, or Firm*—Oliff & Berridge, PLC

(57) ABSTRACT

A fixing device 2 includes a primary fixing device 5 disposed in a transporting path 4 for a recording material 3, and a secondary fixing device 6 disposed in the downstream of the primary fixing device 5. The recording material is passed through only the primary fixing device 5 after an image is recorded on an front surface of the recording material 3. Subsequently, an image is recorded on a rear surface of the recording material 3 and the recording material is passed through the primary fixing device 5 and the secondary fixing device 6. The fixing device 2 includes a primary ejection path 7 for ejecting the recording material 3 having passed through the primary fixing device 5 and a secondary ejection path 8 for ejecting the recording material 3 having passed through the primary fixing device 5 and the secondary fixing device 6 in this order.

17 Claims, 10 Drawing Sheets

IMAGE FORMING APPARATUS AND FIXING UNIT USED THEREFOR

BACKGROUND OF THE INVENTION

1. Field of the Invention

The present invention relates to an image forming apparatus, such as a copying machine or a printer. More particularly, the invention relates to an image forming apparatus with a plurality of fixing devices and a fixing unit for use with the image forming apparatus.

2. Description of the Related Art

There has been proposed an image forming apparatus having a plurality of fixing devices.

In the image forming apparatus, for example, a plurality of fixing devices are disposed in parallel along a traveling direction of a recording material to selectively change the fixing devices in use (e.g., JP-A-2000-221834).

In this type of the image forming apparatus, even in a consecutive recording operation, there is no need to wait until the temperature of the fixing device rises halfway through a consecutive recording operation. Accordingly, the apparatus is capable of performing the recording operation at high speed.

In the image forming apparatus according to the related art having the plurality of fixing devices, those fixing devices are not the ones specially designed for recording an image at high quality. Accordingly, the image forming apparatus is incapable of recording the image at high quality.

As means for solving such a problem, a technique (for example, JP-A-Hei.10-123863) can be applied in which in order to obtain a photographic image, a special toner is used to vary the fixing speed, the fixing pressure, the fixing temperature, and the like in a fixing step.

However, in this type of the related art, since the recording material always passes through the plurality of fixing devices, excessive fixing is performed for recording in the normal image quality, thereby impairing the productivity.

As a related art for obtaining the high image quality by using the normal toner, a technique (for example, JP-A-Hei.6-258970) has been proposed in which a plurality of fixing devices are disposed in parallel along a transporting path of a recording material and the recording material is passed through nip regions of both fixing devices in order to improve the fixing property.

However, in this type of the related art, since the recording material always passes through the plurality of fixing devices, excessive fixing is performed for recording in the normal image quality. Therefore, it is concerned to impair the productivity.

More specifically, in a case of forming an image having the high image quality such as a photographic image on a recording material, generally, there are fewer requests to form the image having the high image quality on both sides of the recording material. For example, in a case of preparing a post card photographic-printed, in most cases, it is sufficient only have to form an image having the normal image quality on one side of the recording material so long as the image having the high image quality such as a photographic image is formed on the other side of the recording material.

Under this circumstance, when a post card is prepared on one side of which a photo is printed, for example, in a both-side recording mode, in spite of being allowed to form an image having the normal image quality on a side of the post card where the photo is not printed, a plurality of fixing devices perform the fixing process. Therefore, not only excessive fixing process is performed, but also since the post card always passes through the plurality of fixing devices, the productivity in a one-side recording mode can be impaired.

SUMMARY OF THE INVENTION

The invention has been made to solve the above described technical problems. According to an aspect of the invention, there is provided an image forming apparatus comprising:

an image forming module for forming images on both sides of a recording material sequentially; and a fixing device for fixing the images on both sides of the recording material, wherein the fixing device includes a primary fixing device disposed in a recording material transporting path and a secondary fixing device disposed in the downstream of the primary fixing device; and the recording material is passed through only the primary fixing device after an image is recorded on a front surface of the recording material, an image is recorded on a rear surface of the recording material, and subsequently, the recording material is passed through the primary fixing device and the secondary fixing device.

Accordingly the image quality is well maintained in the high image quality and the productivity can be improved.

DESCRIPTION OF THE INVENTION

Here, technical objects to be solved are described specifically. One of the technical objects is that the image quality is well maintained in the high image quality while ensuring the productivity in both-side recording mode. Another one of the technical objects is that the productivity in the normal image quality mode (standard mode) can be ensured and further in the high quality mode, the image quality is well maintained in the high image quality.

Figure 1:
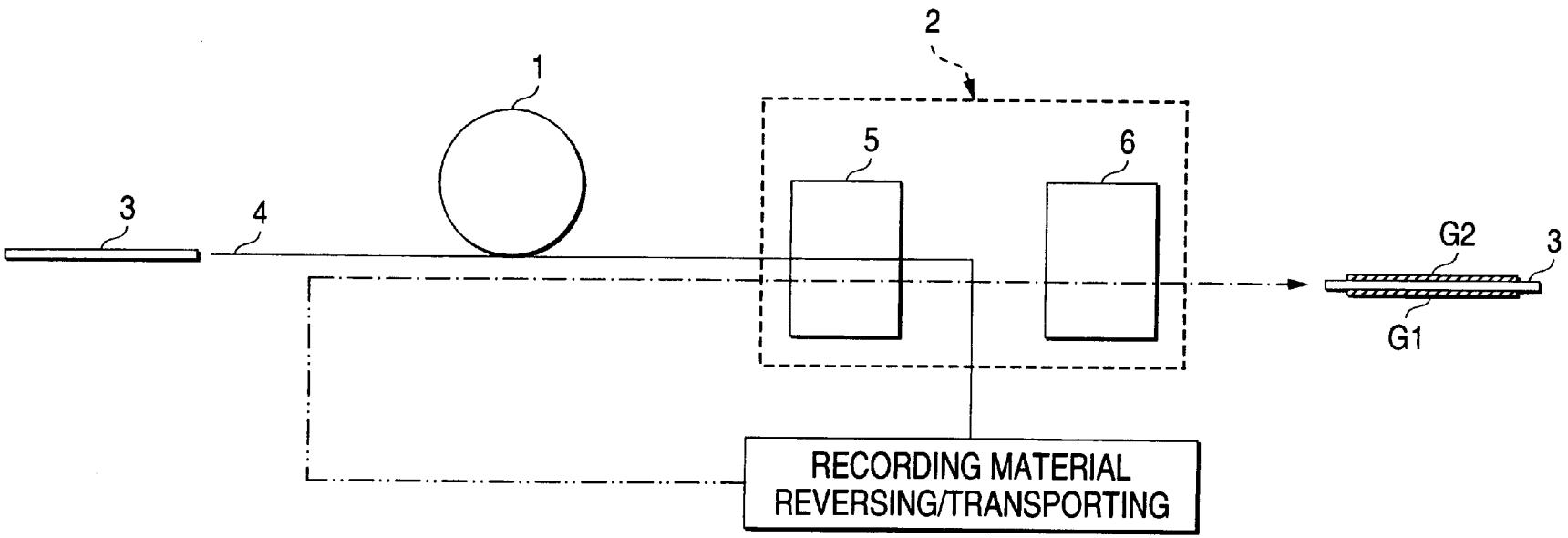
FIG. 1 is an explanatory diagram showing an outline of an image forming apparatus according to the invention.

That is, as shown in FIG. 1, according to the invention, there is provided an image forming apparatus comprising an image formation module 1 for recording an image on both sides of a recording material 3 sequentially and a fixing device 2 for fixing an image G (specifically, G1 denotes front surface image and G2 denotes rear surface image) recorded on the both sides of the recording material 3. The fixing device 2 has a primary fixing device 5 disposed along a transporting path 4 of there recording material 3 and a secondary fixing device 6 disposed in a downstream side of the primary fixing device 5. The recording material 3 is passed through only the primary fixing device 5 after an image is recorded on the front surface of the recording material 3. After an image is recorded on the rear surface of the recording material 3, the recording material 3 is passed through the primary fixing device 5 and the secondary fixing device 6.

In this technical means, the invention is effective in a case of forming images different in the fixing property (for example, an image having the high image quality and an image having the normal image quality) as the front surface image G1 and rear surface image G2 of the recording material 3.

Here as the image formation module 1, one forming images on the both sides of the recording material 3 simultaneously is not included. One forming images on the both sides of the recording material 3 sequentially may be selected appropriately as the image formation module 1. For example, the image formation module 1 is constructed so that after recording an image on the front surface, the recording material 3 is reversed and transported to return an image forming position to record an image on the rear surface.

The image formation by the image formation module 1 may be selected appropriately. An image requiring sufficient fixing property (for example, an image having the high image quality) is formed as the rear surface image G2.

In this case, typical image formation system of the image formation module 1 include that mono color recording is performed on the front surface of the recording material 3 and color image recording is performed on the rear surface of the recording material 3.

A specific embodiment and a fixing condition in relation to the primary fixing device 5 and secondary fixing device 6 constructing the fixing device 2 can be selected appropriately. In view of well maintaining the fixing property of an image requiring sufficient fixing property (for example, an image having the high image quality), it is preferable that at least an aspect of the secondary fixing device 6 is contrived and further various kinds of fixing condition such as the fixing speed, the fixing temperature, the fixing pressure, and the like are optimized.

Further more, as a preferable fixing condition of the primary fixing device 5 and secondary fixing device 6, the primary fixing device 5 only have to be set a primary fixing condition in which a fixed image is not peeled during the recording material 4 passes through the transporting path 4 and the secondary fixing device 6 only have to be set a secondary fixing condition in which an image is sufficiently fixed to the recording material 3.

A relation of a fixing speed condition between the primary fixing device 5 and the secondary fixing device 6 may be selected appropriately.

For example, it is preferable that the fixing speed of the secondary fixing device 6 is set to be more slower than that of the primary fixing device 5. In this case, the perfect fixing property by the secondary fixing device 6 is ensured and the fixing speed of the primary fixing device 5 is set to be faster than that of the secondary fixing device 6, thereby facilitating to ensure the productivity in the one-side recording and the both-side recording.

Here, difference in the fixing speed between the both fixing devices 5 and 6 may be selected appropriately. In view of juggling the productivity with the fixing property of an image having the high image quality, it is preferable that the fixing speed of the primary fixing device 5 is set to be as about 1.5 to 4 times as that of the secondary fixing device 6.

Further more, when the both fixing devices 5 and 6 have a difference in the fixing speed, in view of avoiding an interference between the both, it is preferable that a transporting path between the primary fixing device 5 and the secondary fixing device 6 is made to be a reverse path in which the recording material 3 is reversed to cross-transport a precedent recording material and a subsequent recording material in the reverse transporting path.

According to this aspect, the difference of the fixing speed between the both fixing devices 5 and 6 can be absorbed without increasing a distance between the both fixing devices 5 and 6.

In this aspect the recording material 3 is not simultaneously passed through each of fixing regions of the primary fixing device 5 and the secondary fixing device 6 and therefore, even if each of fixing devices 5 and 6 adopts a nip transporting system, the transporting characteristic of the recording material 3 does not have any disadvantage and is hardly wrinkled Further more, as another aspect in which the difference of the fixing speed between the both fixing devices 5 and 6 is absorbed, the transporting path between the primary fixing device 5 and the secondary fixing device 6 is formed so that a rear end of the recording material has passed through the primary fixing device 5 and then a front end of the recording material 3 reaches the secondary fixing device 6.

Specifically, the length of the transporting path between the fixing regions of the both fixing devices 5 and 6 is set to be longer than the length of the maximum size of the recording material 3.

Further more, under a condition in which after the recording material 3 passes through the primary fixing device 5 and subsequently, the recording material 3 passes through the secondary fixing device 6, the fixing speed of the primary fixing device 5 and that of the secondary fixing device may be set to be the same.

For example, in a high image quality mode, in case of using the both fixing devices 5 and 6, the fixing speed of the both fixing devices may be reduced.

In this aspect, since the fixing speed of the both fixing devices 5 and 6 are identical with each other, the recording material can be transported to straddle the fixing regions of the both fixing devices 5 and 6.

Figure 2:
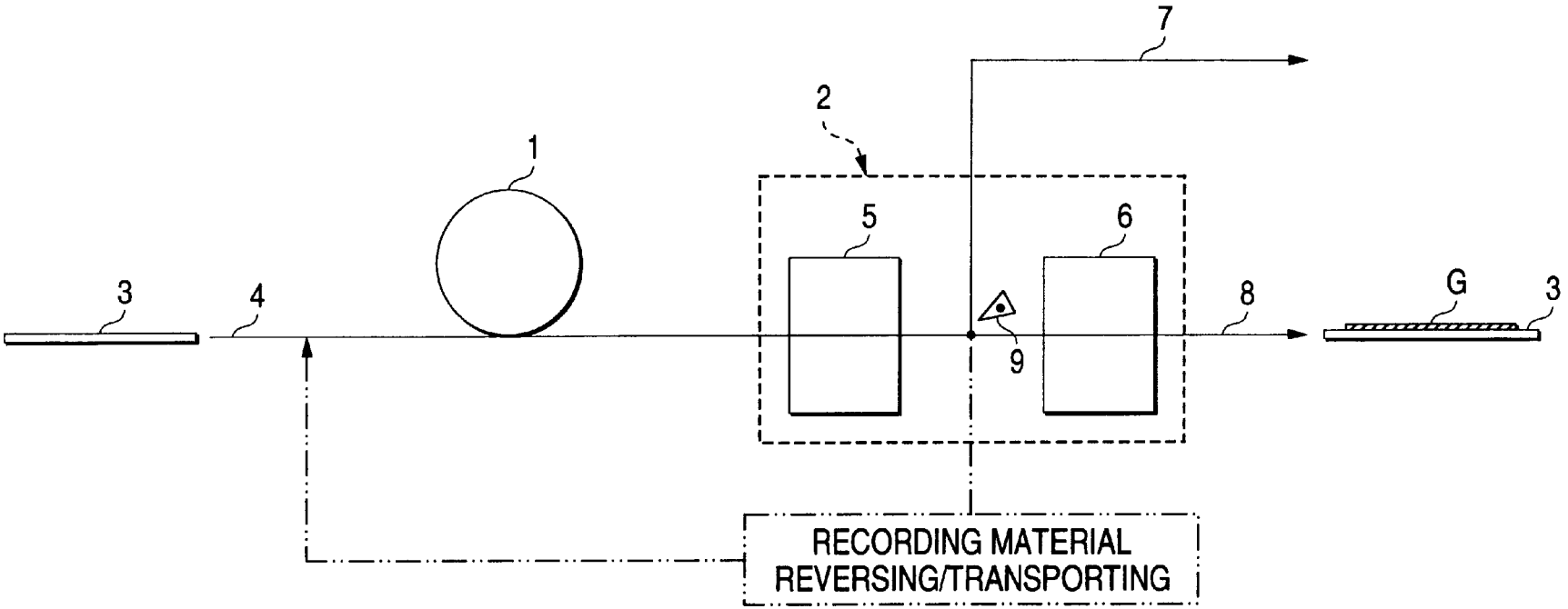
FIG. 2 is an explanatory diagram showing an outline of an image forming apparatus according to another embodiment of the invention.

According to another aspect of the invention, as shown in FIG. 2, there is provided an image forming apparatus comprising an image formation module 1 for recording an image on a recording material 3 and a fixing device 2 for fixing an image G recorded on the recording material 3, wherein the fixing device 2 has a primary fixing device 5 disposed along a transporting path 4 of the recording material 3 and a secondary fixing device 6 disposed in a downstream side of the primary fixing device 5, the image forming apparatus further comprising a primary ejection path 7 for ejecting the recording material 3 after passed through the primary fixing device 5 and a secondary ejection path 8 for ejecting the recording material after passed through the primary fixing device 5 and sequentially, passed through the secondary fixing device 6.

In this technical means, the image forming apparatus according to this aspect can respond to a case in which sufficient fixing property (for example, the high image quality) as a fixed image to the recording material and a case not requiring, respectively.

Specifically, by responding with "the primary fixing device 5+the primary ejection path 7" and with "the primary fixing device 5+the secondary fixing device 6+the secondary ejection path", respectively, for example, in a case of the high image quality mode, the image quality can be improved by the latter operation and on the other hand, in a case of the normal image quality (standard) mode, the productivity can be ensured by the former operation.

Further more, in order to change the primary ejection path 7 and the secondary ejection path 8 with each other, it is necessary to provide a switching unit 9 for changing and selecting any one of the primary ejection path 7 and secondary ejection path 8 in response to, for example, a use condition of the recording material.

A specific embodiment and a fixing condition in relation to the primary fixing device 5 and secondary fixing device 6 constructing the fixing device 2 can be selected appropriately.

Here, as a preferable fixing condition of the primary fixing device 5 and secondary fixing device 6, for example, the primary fixing device 5 is set to a primary fixing condition in which an image is sufficiently fixed to the recording material 3 under a standard condition in which a use condition of the recording material 3 is standard and the secondary fixing device 6 is set to a secondary fixing condition in which an image is sufficiently fixed to the recording material under a particular condition in which a use condition of the recording material 3 is particular.

The use condition of the recording material 3 is not only different depending on type of the recording material (normal paper, photo paper) but also different depending on type of image information (black/white image, color image).

A relation of a fixing speed condition between the primary fixing device 5 and the secondary fixing device 6 may be selected appropriately as well as the invention shown in FIG. 1.

Further more, the image forming apparatus according to the invention may have the primary fixing device 5 and the secondary fixing device 6 in a main body of the apparatus in advance. As a preferable configuration, there is provided an image formation unit having the primary fixing device 5 therein and a fixing unit having the secondary fixing unit therein, the fixing unit constructed another unit than the image formation unit.

The invention is not limited to the image forming apparatus. The invention can be applied to a fixing unit used for the image forming apparatus.

In this case, the fixing unit according to the invention comprising an image formation unit having the primary fixing device 5 therein and a fixing unit having the secondary fixing unit therein, the fixing unit constructed another unit than the image formation unit.

Here, when the image forming apparatus as shown in FIG. 2 is constructed simply, it is preferable to provide the primary ejection path 7 for ejecting the recording material after passed through the primary fixing device 5 and the secondary ejection path 8 for ejecting the recording material 3 after passed through the primary fixing device 5 and sequentially passed through the secondary fixing device 6 as the fixing unit.

According to this aspect, since the ejection path of the recording material can be designed at the fixing unit side, apparatus configuration in which the image formation unit side is standardized to some extent can be adopted.

DETAILED DESCRIPTION OF THE PREFERRED EMBODIMENTS

The preferred embodiments of the present invention will be described in detail with reference to the accompanying drawings.

<Embodiment 1>

Figure 3:
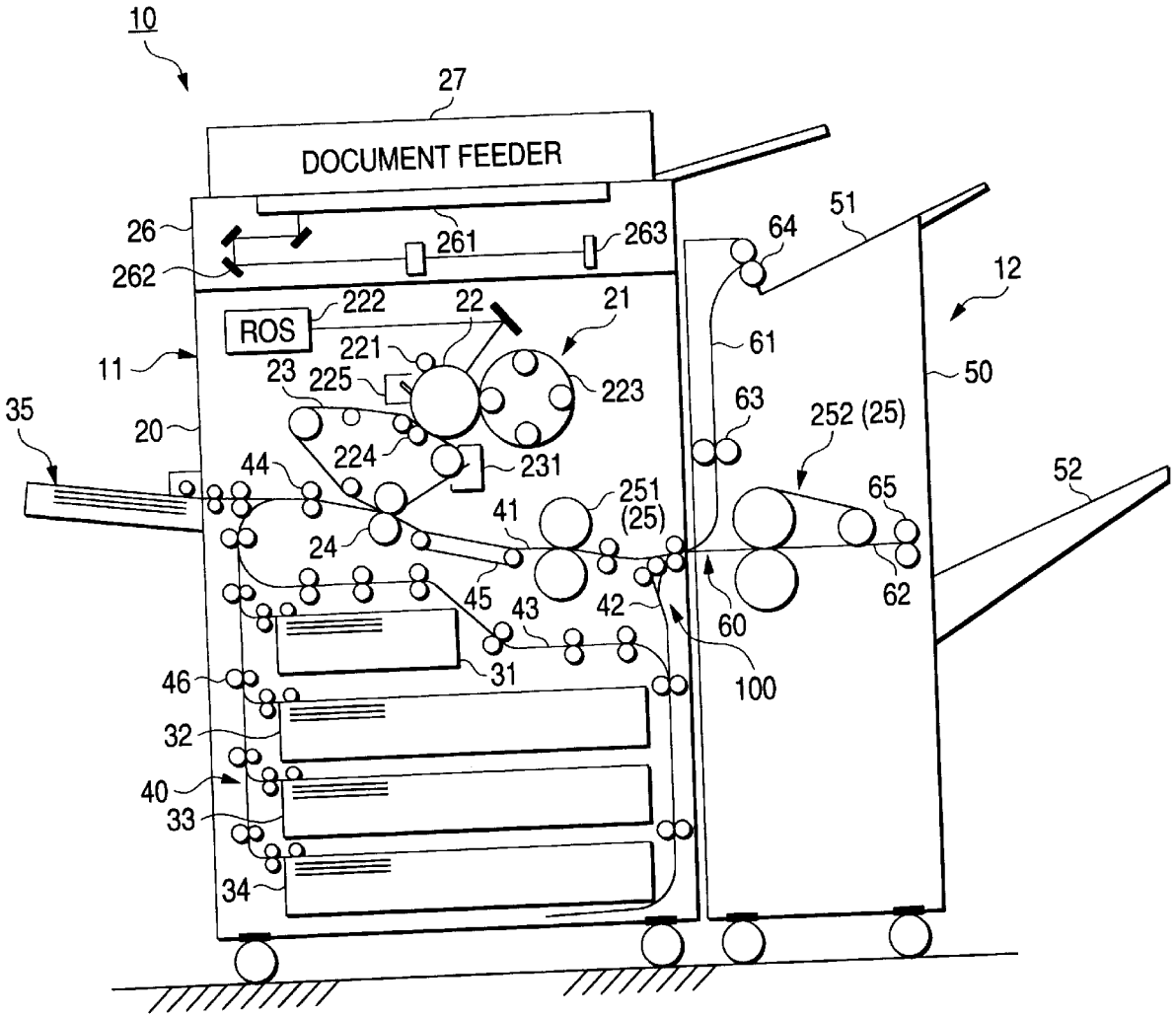
FIG. 3 is an explanatory diagram showing a whole construction of an image forming apparatus according to an embodiment 1.

FIG. 3 is an explanatory diagram showing an image forming apparatus according to the embodiment 1 to which the invention is applied.

As shown in figure, an image forming apparatus 10 includes an image forming unit 11 capable of forming color images and a fixing unit 12 which is coupled to the image forming unit 11.

In the embodiment, an image input terminal 26 (abbreviated as IIT) for reading an image on an original document is disposed in the upper part of a main body of the image forming apparatus 20 and a document feeder 27 for feeding the original to the image input terminal 26 is disposed on the image input terminal 26. An image forming module 21 is disposed within the main body 20 and a multiple of recording material supplying trays 31 to 34 are disposed under the image forming module 21. A multi sheet inserter 35 (abbreviated as MSI) is attached to the side of the main body 20 in an opening/closing fashion.

The image forming module 21 used in this embodiment is, for example, employed the electrophotography technique. In the image forming module 21, there is disposed a photosensitive drum 22 for forming and holding toner images of each of colors thereon. Those color toner images are successively and primarily transferred from the photosensitive drum 22 to an intermediate transfer belt 23. The superimposed color toner image is secondarily transferred from the intermediate transfer belt 23 onto a recording material by means of a secondary transfer device 24 including a secondary transfer roll, and the resultant is guided to fixing device 25.

Disposed around the photosensitive drum 22 are electrophotographic devices, such as a charger 221, an exposure device 222, a developing device 223, a primary transfer device 224, and a cleaner 225. The charger 221 charges the photosensitive drum 22. The exposure device 222 includes a laser scanning device and the like, the laser scanning device for forming an electrostatic latent image on the photosensitive drum 22. The developing device 223, which contains color toner, develops the electrostatic latent image on the photosensitive drum. The primary transfer device 224 including a transfer roll transfers the toner image of each of colors from the photosensitive drum 22 onto the intermediate transfer belt 23. The cleaner 225 removes residual toners from the photosensitive drum 22.

The intermediate transfer belt 23 is stretched around a plurality of tension rolls, circulated, and transported. The secondary transfer device 24 is disposed in opposition to one of the tension rolls as a backup roll. Reference numeral 231 is a cleaner for cleaning the intermediate transfer belt 23.

In the embodiment, the fixing device 25 includes a primary fixing device 251 and a secondary fixing device 252. The primary fixing device 251 is disposed in the upstream of a transporting path of the recording material. The secondary fixing device 252 is disposed in the downstream of the primary fixing device 251 and is contained within the fixing unit 12.

Specific configuration of the fixing devices 251 and 252 will be described later.

In the embodiment, a transporting path 40 from the recording material supplying trays 31 to 34 includes a main transporting path 41, an reversing path 42 and a returning path 43. The main transporting path 41 extends upwardly from the side of the main body 20, which is opposed to the fixing unit 12, to the fixing unit 12 via the secondary transfer region and primary fixing region of the image forming module 21. The reversing path 42, shaped like "Y", is located downstream of the main transporting path 41 and at a position near the exit of the main transporting path 41. The reversing path 42 reverses and transports the recording material. The returning path 43, which is connected to the reversing path 42, returns the reversed recording material to the main transporting path 41, which is located before the image forming module 21.

A registration roll 44 is disposed in the upstream of the secondary transfer region of the main transporting path 41 and positions the recording material and then transports it. A transporting belt 45 is disposed in the downstream of the secondary transfer region and transports the recording material to the primary fixing device 251. An appropriate number of transporting rolls 46 are provided along each of the transporting paths 40.

A recording material feeding part of the MSI 35 is communicated and connected to the horizontal part of the main transporting path 41.

In this embodiment, the fixing unit 12 is provided with upper ejection tray 51 and a lower ejection tray 52. The upper ejection tray 51 is attached to the upper end of a main body 50 of the fixing unit and the lower ejection tray 52 is attached to a mid position of the side of the main body 50. Within the unit main body 50, a transporting path 60 is disposed which communicates from the apparatus main body 20 to a recording material ejection port. The transporting path 60 includes a first transporting path 61 (corresponding to a primary ejection path), which extends to the upper ejection tray 51, and a second transporting path 62 (corresponding to a secondary ejection path), which is branched off from the first transporting path 61 to the lower ejection tray 52. The secondary fixing device 252 is disposed at a mid position of the second transporting path 62.

Reference numeral 63 is a transporting roll 63, and numerals 64 and 65 are ejection rolls for ejecting the recording material to the ejection trays 51 and 52.

In the embodiment, the fixing device 25 is constructed as described below.

Figure 5:
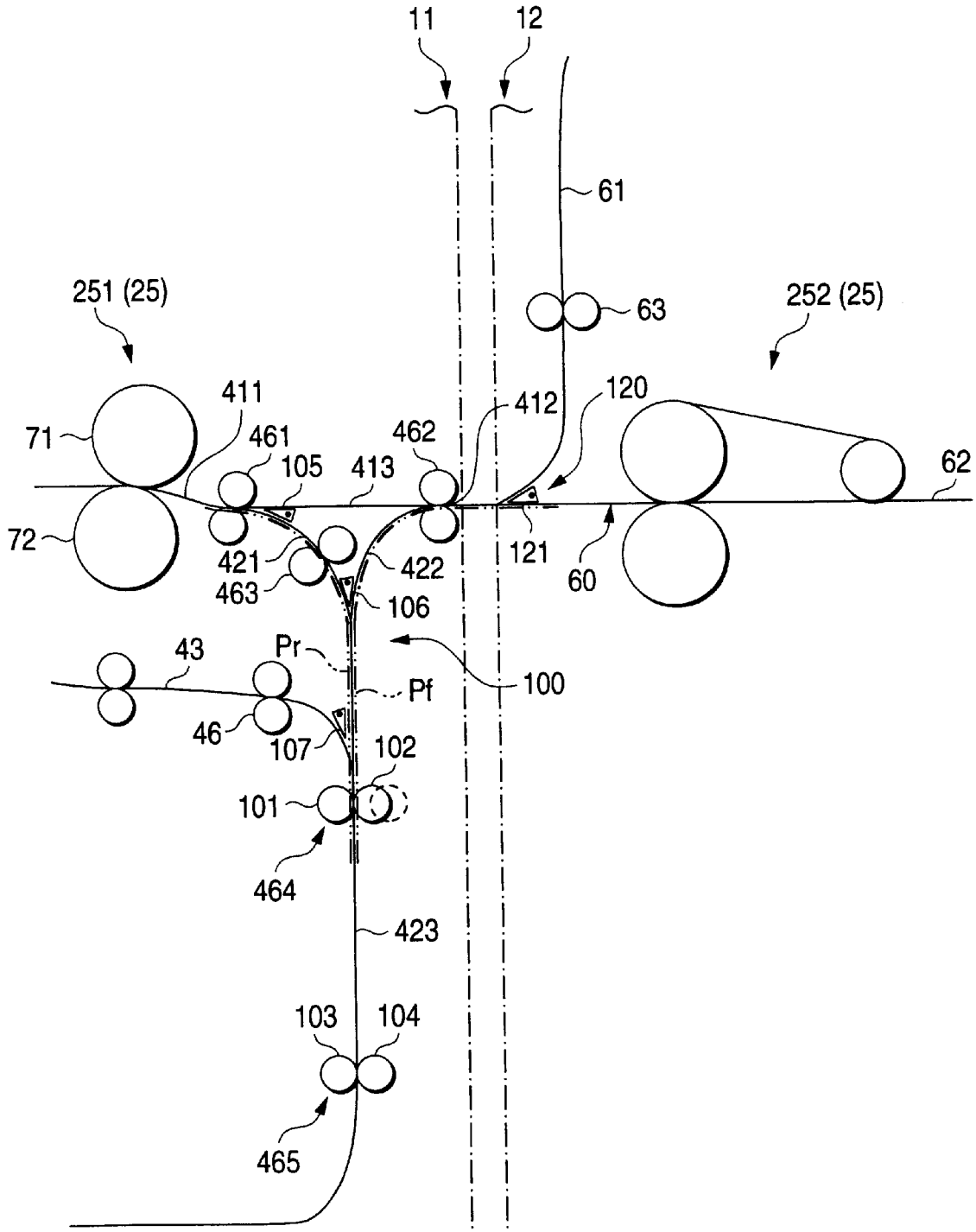
FIG. 5 is an explanatory diagram showing an example of reverse transporting mechanism and ejection path change mechanism of a recording material, which are of transporting mechanisms of the recording material used in this embodiment.

The primary fixing device 251 may be of the known type. In an example of such, as shown in FIG. 5, a heat fuser roll 71 and a pressing roll 72 are brought into contact with each other and in this state those are rotated. The heat fuser roll 71 contains a heating source, e.g., a halogen lamp. The pressing roll 72 is brought into pressing contact with the heat fuser roll 71 at a predetermined pressure, thereby forming a predetermined fixing nip region. If required, the pressing roll 72 may also contain a heating source.

The secondary fixing device 252 may also be of the known type, and particularly in this embodiment, a known primary fixing device is employed with an intention of recording a photographic image having the high image quality on a recording material, e.g., photo paper coated with binder.

An example of the photo paper is a photo paper in which a transparent and thermoplastic resin layer is formed on a substrate.

The substrate may be a plain paper for image forming, coated paper, photographic paper, or the like. The transparent resin layer is a layer (a toner image receiving layer) which is molten and accepts toner at the time of fixing operation. The layer has a thickness of 5 to 30 $\mu$m and is made of thermoplastic resin, such as polyethylene resin, polyester resin, or styrene/acrylic ester resin. The transparent resin layer is formed by a coating method, such as blade coating.

Figure 4A:
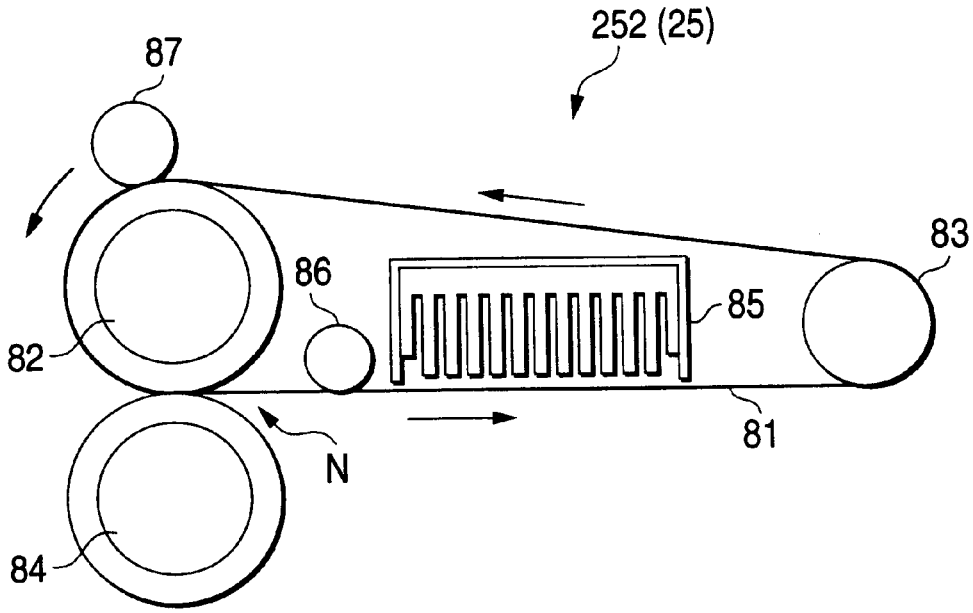
FIG. 4A is an explanatory diagram showing a secondary fixing device of fixing devices used in this embodiment and FIG. 4B is an explanatory diagram showing a modified embodiment thereof.

In the embodiment, as shown in FIG. 4A, the secondary fixing device 252 includes a heat fuser roll 82, a peeling roll 83 and a pressing roll 84. A fixing belt 81 is wound around the heat fuser roll 82 and the peeling roll 83, and circularly moves. The pressing roll 84 presses the heat fuser roll 82 against the fixing belt 81. The secondary fixing device introduces the recording material bearing toner thereon to a fixing nip region "N", which is defined between the fixing belt 81 and the pressing roll 84, and fixes the toner in the transparent resin layer of the recording material.

The fixing belt 81 may be a belt having a single-layer structure, preferably a multi-layer structure, typically, a double-layer structure or a triple-layer structure. In the double-layer structure, at least an elastic layer is layered on a heat resistant substrate. In the triple-layer structure, at least an elastic layer and a surface layer are layered on a heat resistant substrate. If necessary, other function layers than the elastic layer and the surface layer may be layered thereon additionally.

The heat fuser roll 82 includes a roll body and a halogen lamp which is placed in an inner space of the roll body. The roll body is constructed such that a core member made of aluminum, stainless steel, or the like is covered with a layer.

The peeling roll 83 facilitates the peeling of the recording material from the fixing belt 81. The recording material is transported while being in contact with the fixing belt 81. The fixing belt 81 is tightly put on the peeling roll 83 while being bent at a predetermined curvature. The peeling roll 83 is made of a metallic material or the like.

The pressing roll 84 is arranged so as to press the fixing belt 81 against the heat fuser roll 82. Further, the pressing roll 84 has the same layer structure as that of the roll body of the heat fuser roll 82, for example.

A fixing operation by the secondary fixing device 252 is performed in the following way.

The recording material, which bears a toner image thereon, is transported and fed to the fixing nip region "N" between the fixing belt 81 and the pressing roll 84 of the secondary fixing device 252, by a recording material transporting system including the transporting roll 46 and others.

Thereafter, at the fixing nip region "N", toner and transparent resin layer of the recording material are heated, pressed, and molten, and then the toner is buried into the transparent resin layer of the recording material.

Subsequently, the recording material having passed through the fixing nip region is transported in a direction of an arrow with the rotation of the fixing belt 81 in a state where the recording material is in pressing contact with the outer peripheral surface of the fixing belt 81. In this state, the recording material is naturally cooled during its traveling through a cooling region, which is up to near the peeling roll 83. The toner is cooled and hardened in a state where the toner is buried in the transparent resin layer of the recording material. In case that the recording material does not have the transparent resin layer, the toner is cooled and almost hardened in the surface region of the recording material.

The recording material having passed through the cooling region is transported and reaches the peeling roll 83 while being in contact with the fixing belt 81. The recording material is automatically peeled off the fixing belt 81 being put on the peeling roll 83 in a stretched fashion and here the secondary fixing process ends.

In case that it is difficult to carry out the natural cooling of the recording material on the fixing belt 81 in the embodiment, a cooling member 85 may be provided between the heat fuser roll 82 and the peeling roll 83 and on the inner side of the circle of the fixing belt 81. The cooling member 85 may be constructed so that a heat radiation member, e.g., a heat sink, is pressed against the inner peripheral surface of the fixing belt 81 while the heat sink is air-cooled. Reference numeral 86 is a duct for air-cooling the cooling member 85.

A cleaning device 87 or the like may be provided which removes matters adhering to the outer peripheral surface of the fixing belt 81.

Figure 4B:
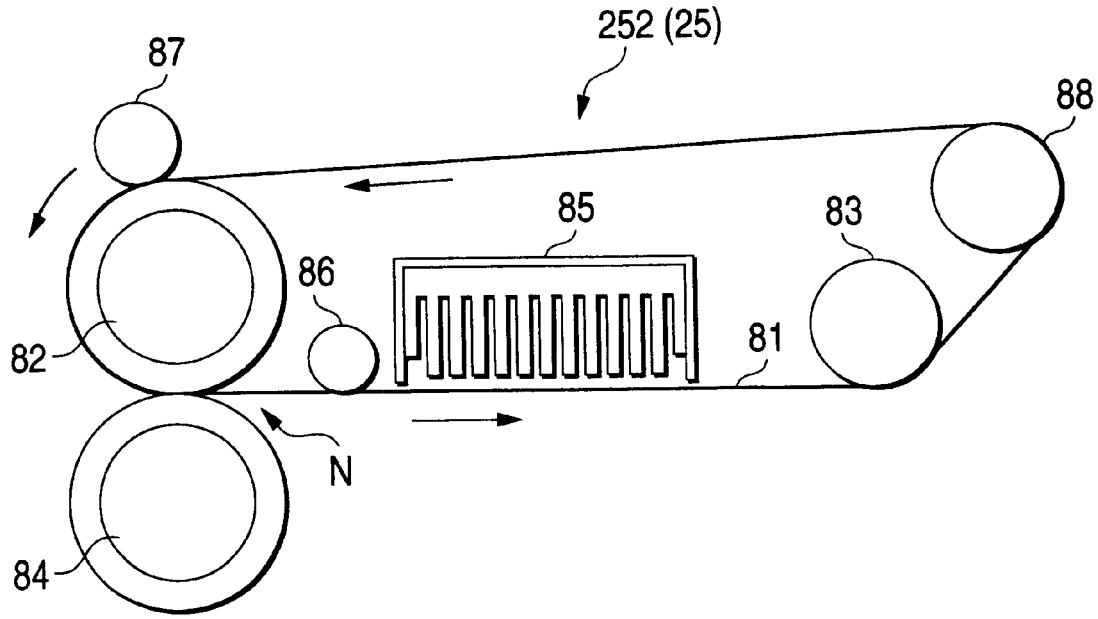

To effectively avoid the meandering of the fixing belt 81, a steering roll 88, which is tiltable, may additionally be provided as one of the tension members for the fixing belt 81, as shown in FIG. 4B. To control the meandering of the fixing belt 81, it is preferable to appropriately tilt the steering roll 88.

In this embodiment as shown in FIG. 5, a recording material reversing/transporting mechanism 100 is provided with the reversing path 42 of the transporting path 40 in the image forming unit 11. Within the fixing unit 12, an ejection path select mechanism 120 is provided to select one of the first transporting path 61 and the second transporting path 62.

In the embodiment, the reversing path 42 is arranged so that, as shown in FIG. 5, an upstream diverging path 421 and a downstream diverging path 422 are connected through a switchback path 423 to form a shape like Y. The upstream diverging path 421 branched off a mid point of an upstream transporting path 411 (a part of the main transporting path 41). The downstream diverging path 422 merges into a downstream transporting path 412 (a part of the main transporting path 41) at a mid position thereof.

The returning path 43 is connected to a mid point of the switchback path 423.

The upstream transporting path 411 and the downstream transporting path 412 are connected by a direct transporting path 413 (a part of the main transporting path 41).

In the embodiment, the primary fixing device 251 is disposed on the upstream transporting path 411. A fuser exit roll 461 (one of the transporting rolls 46) is disposed in the downstream of the primary fixing device 251. In the downstream transporting path 412, an entrance/exit roll 462 (one of the transporting rolls 46) is disposed at the exit of the image forming unit 11, while corresponding to a position, which is the entrance of the fixing unit 12.

In the embodiment, as shown in FIG. 5, in the recording material reversing/transporting mechanism 100, an reversing entrance roll 463 (one of the transporting rolls 46) is provided at a position on the upstream diverging path 421. Two pairs of reversing rolls 464 and 465 (one of the transporting rolls 46) are provided at positions on the switchback path 423.

The first reversing roll 464 located in the upstream of the switchback path 423 has a driving roll 101 and a nip/release roll 102. The driving roll 101 is reversibly driven. The nip/release roll 102 is detachable from the drive roll 101 and follows the driven roll 101 in rotation when contacting with each other.

On the other hand, the second reversing roll 465 located in the downstream of the switchback path 423, unlike the first reversing roll 464, has a driving roll 103 which is driven to reversibly rotate and a driven roll 104 which is pressed against the driving roll 103 and rotates following the driving roll.

In the embodiment, a select gate 105 for path selection is provided at a jointing part between the direct transporting path 413 and the upstream diverging path 421. A select gate 106 for path selection is provided at a jointing part between the upstream diverging path 421 and the downstream diverging path 422. Further, a select gate 107 for path selection is provided at a jointing part between the switchback path 423 and the returning path 43.

In the embodiment, the ejection path select mechanism 120 includes a select gate 121 for selecting the first transporting path 61 or the second transporting path 62.

These select gates 105 to 107 and 121 are each driven for selection by a solenoid or the like.

Next, operations of the image forming apparatus according to the embodiment will be described.

The image forming apparatus of the embodiment is operable in a both-side recording mode and a one-side recording mode. The one-side recording mode includes a standard mode (normal image quality mode) and a high image quality mode, and one of these modes can be selected.

The both-side recording mode and the one-side recording mode are described with reference to the FIGS. 2 to 5, 9, and 10, sequentially.

A. Both-Side Recording Mode

Description will be given about a case where a postcard in which a photographic image is printed on a rear surface thereof and an address and the like are printed on a front surface thereof is formed and an image having the normal image quality (the address and the like in this instance) is formed on the front surface of a recording material and an image having the high image quality (the photographic image in this instance) is formed on the rear surface of the recording material.

A recording material uses is a called photo paper in which a transparent and thermoplastic resin layer is formed on a rear surface of a substrate.

When the image forming apparatus is in the both-side recording mode, as shown in FIG. 3, the image forming module 21 records an image on the front surface of the recording material; the primary fixing device 251 primarily fuses and fixes the image on the recording material; the recording material reversing/transporting mechanism 100 of the reversing path 42 reverses the recording material having the fixed image; and the recording material is transported to the returning path 43.

In the recording material reversing/transporting mechanism 100, as shown in FIG. 5, the select gate 105 is operated and whereby the recording material (not shown) having passed through the primary fixing device 251 is pulled to the switchback path 423 through the select gate 105 and the upstream diverging path 421. At a time when the rear end of the recording material passes through a communicating part between the switchback path 423 and the returning path 43, the first reversing rolls 464 and 465 are reversely rotated, and the select gate 107 is operated, whereby the recording material is transported to the returning path 43.

Thereafter, in the image forming apparatus, the recording material is returned from the returning path 43 to the main transporting path 41 by way of a select gate (not shown); the image forming module 21 forms an image on the rear surface of the recording material; the recording material passes through the primary fixing device 251 and the secondary fixing device 252; and the recording material having the fixed image is ejected to the lower ejection tray 52.

In this state, the recording material having passed through the primary fixing device 251 is transported along the main transporting path 41 to the entrance/exit roll 462 of the image forming unit 11, and then is guided to the transporting path 60 of the fixing unit 12.

In this embodiment, the second transporting path 62 is selected-by the ejection path select mechanism 120 and the recording material that is transported into the fixing unit 12 is subjected to a fixing process by the secondary fixing device 252, and ejected into the lower ejection tray 52.

During such an operation process, in the embodiment, the fixing speed of the primary fixing device 251 and the secondary fixing device 252 are set at a fixing speed v1 (e.g., 220 mm/sec). The fixing temperature, the fixing pressure and the like are selected for each of the primary fixing device 251 and the secondary fixing device 252.

In this case, the fixing conditions including the fixing speed v1 of the primary fixing device 251 may be set up to such an extent as not to peel off the image recorded on at least the front surface or the rear surface of the recording material during its transportation through the transporting path 40 (41 to 43).

The fixing conditions including the fixing speed v1 of the secondary fixing device 252 are selected such that the image (high image quality) on the rear surface of the recording material is fused and fixed to such an extent as to be buried into the transparent and thermoplastic resin layer of the recording material.

By so doing, the rear surface image of the recording material is improved in color development, and free from a piling height, and has a high image quality comparable with a photograph.

The front surface image on the recording material is secondarily fixed to some extent by the secondary fixing device 252. Accordingly, a satisfactory fixing property of the front surface image on the recording material is also secured.

Figures 9A, 9B, 9C:
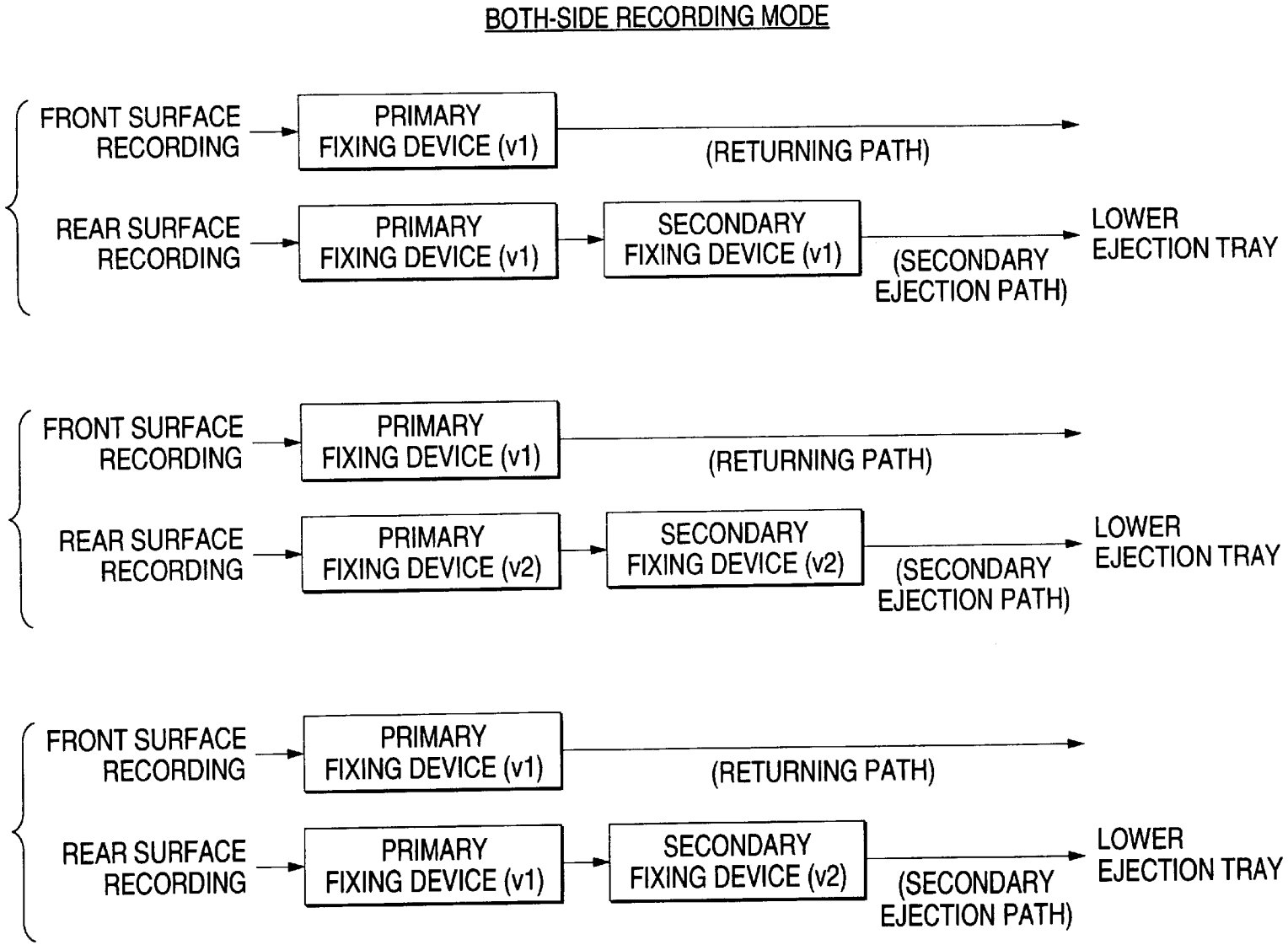
FIGS. 9A and 9B show an example of operation in the both-side recording mode used in the embodiment 1 and FIG. 9C is an explanatory diagram showing an example of operation in the two-side mode used in the embodiments 2 and 3.

In the embodiment shown in FIG. 9A, in the both-side recording mode, the fixing speed of the front surface and rear surface recording of the primary and the secondary fixing devices 251 and 252 are each set at vi. However, setting of the fixing speed is not limited to this. If required, as shown in FIG. 9B, in the front surface recording operation, the fixing speed of the primary fixing device 251 is set at vi, and in the rear surface recording operation, the fixing speed of the primary fixing device 251 and the secondary fixing device 252 are each set at v2, slower than vi (e.g., 60 mm/sec and v1>v2).

In this case, much time can be secured for the fixing time of the rear surface image on the recording material. Therefore, the fixing property of the high image quality on the recording material may be kept in more satisfactory level.

In the embodiment, the recording material does not pass through the secondary fixing device 252 in the front surface recording operation, and hence the productivity of the image forming apparatus in the both-side recording mode can be improved when comparing with the image forming apparatus according to the related art which has a plurality of fixing devices and the recording material is moved to pass through the plurality of fixing devices in both the front surface and rear surface recording operations.

B. One-Side Recording Mode

B-1. Standard Mode (Normal Image Quality Mode)

An operation of the image forming apparatus when an image having a normal image quality is recorded on one side of a recording material, which is a plain paper or the like, will be described.

Figures 10A, 10B, 10C:
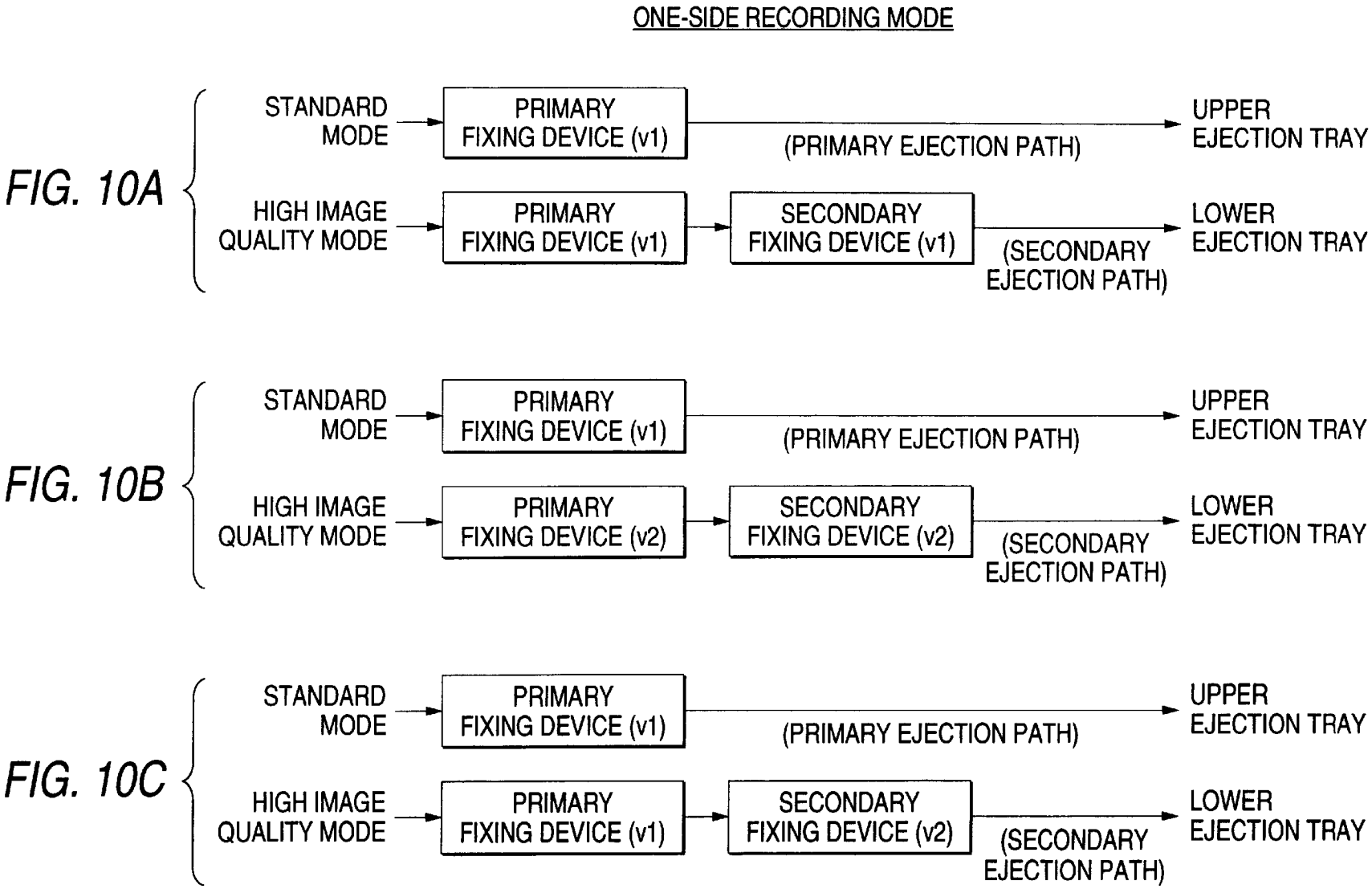
FIGS. 10A and 10B show an example of operation in the one-side recording mode used in embodiment 1 and FIG. 10C is an explanatory diagram showing an example of operation in the one-side mode used in the embodiments 2 and 3.

When the image forming apparatus is in a one-side recording mode and in a standard mode, the image forming module 21 records an image on one side of the recording material as show in FIG. 10A. The primary fixing device 251 carries out the primary fixing of the toner image on the recording material. Thereafter, the recording material then passes through the fixing unit 12 and is ejected to the upper ejection tray 51.

At this time, the first transporting path 61 has been selected by the ejection path select mechanism 120. Accordingly, the recording material having passed through the primary fixing device 251 is transported along the main transporting path 41 to the entrance/exit roll 462 of the image forming unit 11, and guide to the transporting path 60 of the fixing unit 12. Thereafter, the recording material is ejected to the upper ejection tray 51 through the first transporting path 61.

In this state, the fixing speed of the primary fixing device 251 is set at v1. The fixing conditions including the fixing speed v1 of the primary fixing device 251 must be set up to such an extent as to secure the fixing property of the image having the normal image quality.

The recording material having passed through the primary fixing device 251 is ejected through the first transporting path 61, not through the secondary fixing device 252. Therefore, if the first transporting path 61 is designed to be shorter than the second transporting path 62, the productivity is improved when the image forming apparatus is in the one-side recording mode (standard mode).

In the embodiment, the recording material is ejected to the upper ejection tray 51 in a state where the image receiving surface of the recording material is directed upward, that is, so called face-up ejection. If a called face-down ejection in which the image receiving surface of the recording material is directed downward is employed, the recording material reversing/transporting mechanism 100 may be used.

In this case, in the recording material reversing/transporting mechanism 100, as shown in FIG. 5, the preceding recording material having passed through the primary fixing device 251 is pulled, by the select gate 105, to the upstream diverging path 421 of the reversing path 42 and the switchback path 423. At a time when the rear end of the preceding recording material enters the switchback path 423, the select gate 106 is switched, and the reversing roll 464 and 465 are reversely rotated, and whereby the preceding recording material is guided to the downstream transporting path 412 of the main transporting path 41 through the downstream diverging path 422.

In this embodiment, if as indicated by a phantom line of FIG. 5, at a time when the preceding recording material Pf is nipped by the entrance/exit roll 462, the first reversing roll 464 is released from a nipping state, then the subsequent recording material Pr can be pulled to the reversing path 42. Accordingly, the preceding recording material Pf and the subsequent recording material Pr can cross each other in the switchback path 423. By so doing, the recording material can be ejected in the face-down mode without reducing the productivity when the image forming apparatus is in the one-side recording mode (standard mode). At a time when the rear end of the preceding recording material Pf as viewed in a traveling direction, the first reversing roll 464 returns to the nipping state so that the first reversing roll 464 can eject the subsequent recording material Pr in the face-down ejection mode.

B-2. High Image Quality Mode

It is assumed that an image having high image quality is formed on one side of the recording material, and that the recording material is a called photo paper, which is formed by coating one side of a substrate with transparent and thermoplastic resin.

The image forming apparatus, as shown in FIG. 10A, records an image on one side of the recording material by the image forming module 21. Thereafter, the recording material is transported to pass through the primary fixing device 251 and then the secondary fixing device 252. Finally, the recording material fused and fixed is ejected into the lower ejection tray 52.

In this state, the second transporting path 62 has been selected by the ejection path select mechanism 120, and the recording material bearing the image thereon is subjected to a primary fixing process by the primary fixing device 251 and then to a secondary fixing process by the secondary fixing device 252 and ejected into the lower ejection tray 52.

During such an operation process, in the embodiment, the fixing speed of the primary fixing device 251 and the secondary fixing device 252 are set at v1. The fixing conditions including the fixing speed v1 of the secondary fixing device 252 are set up so that the image (high image quality) on the recording material is fused and fixed to such an extent as to be buried into the transparent and thermoplastic resin layer of the recording material.

In the embodiment, the fixing speed of the primary fixing device 251 and the secondary fixing device 252 are set at v1. However, the fixing speed of the first and second fixing devices 251 and 252 is not limited to this. If necessary, as shown in FIG. 10B, in the standard mode, the fixing speed of the primary fixing device 251 is set at v1, and in the high image quality mode, the fixing speed of the primary fixing device 251 and the secondary fixing device 252 are set at v2, slower than v1.

In this case, much time may be secured for the fixing time of the image having the high image quality on the recording material. Therefore, the fixing property of the image having the high image quality on the recording material can be kept at more satisfactory level.

<Embodiment 2>

Figure 6:
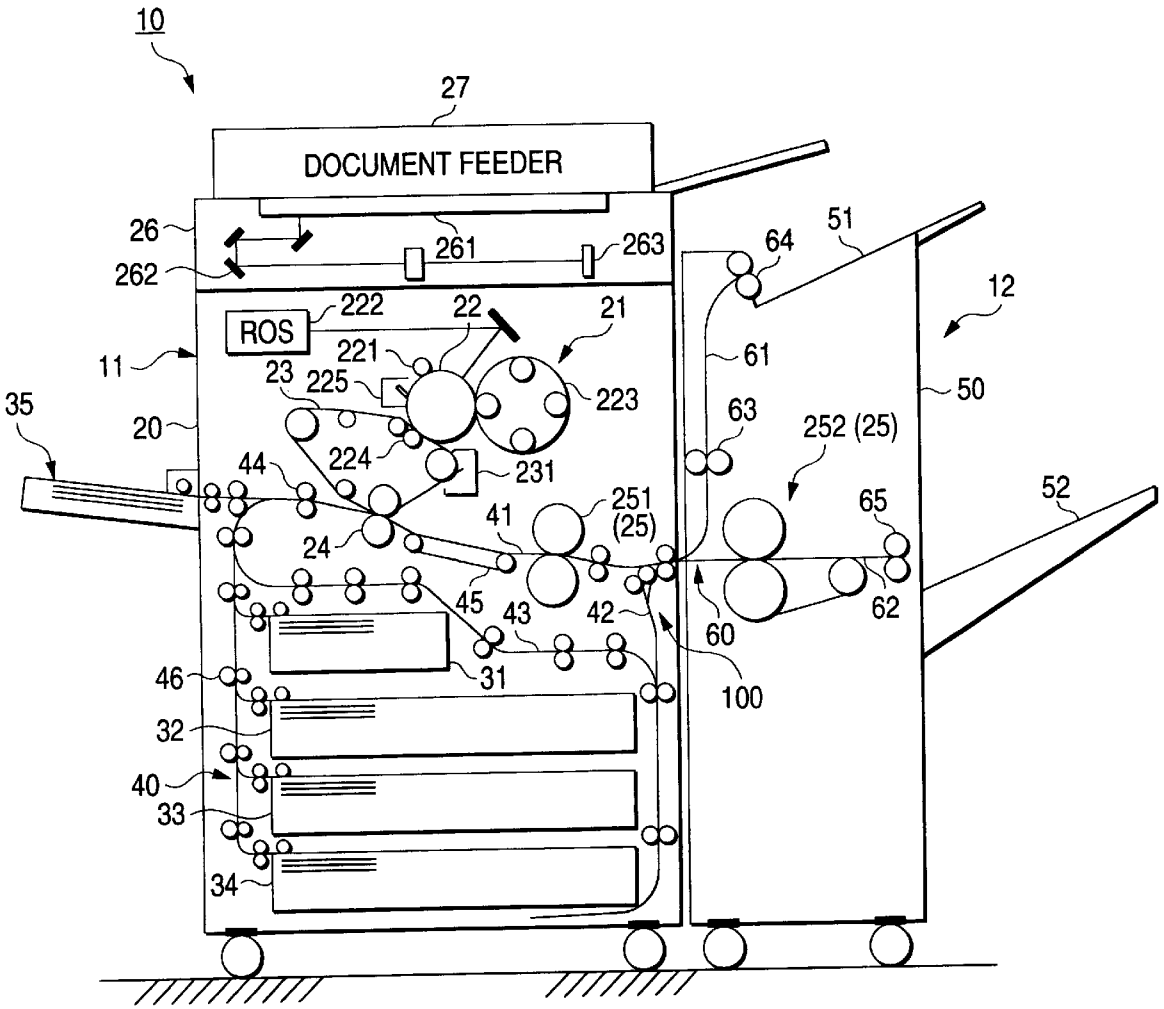
FIG. 6 is an explanatory diagram showing an outline of an image forming apparatus according to an embodiment 2.

FIG. 6 shows an image forming apparatus according to the embodiment 2 to which the invention is applied.

In FIG. 6, the image forming apparatus according to the embodiment 2 is substantially the same as of the embodiment 1 except that the fixing speed of the first fixing device 251 of the fixing device 25 is different from that of the secondary fixing device 252 and difference in the fixing speed is absorbed. In the figure, like or equivalent portions are designated by the same reference numerals as used in the description of the embodiment 1.

Figure 7:
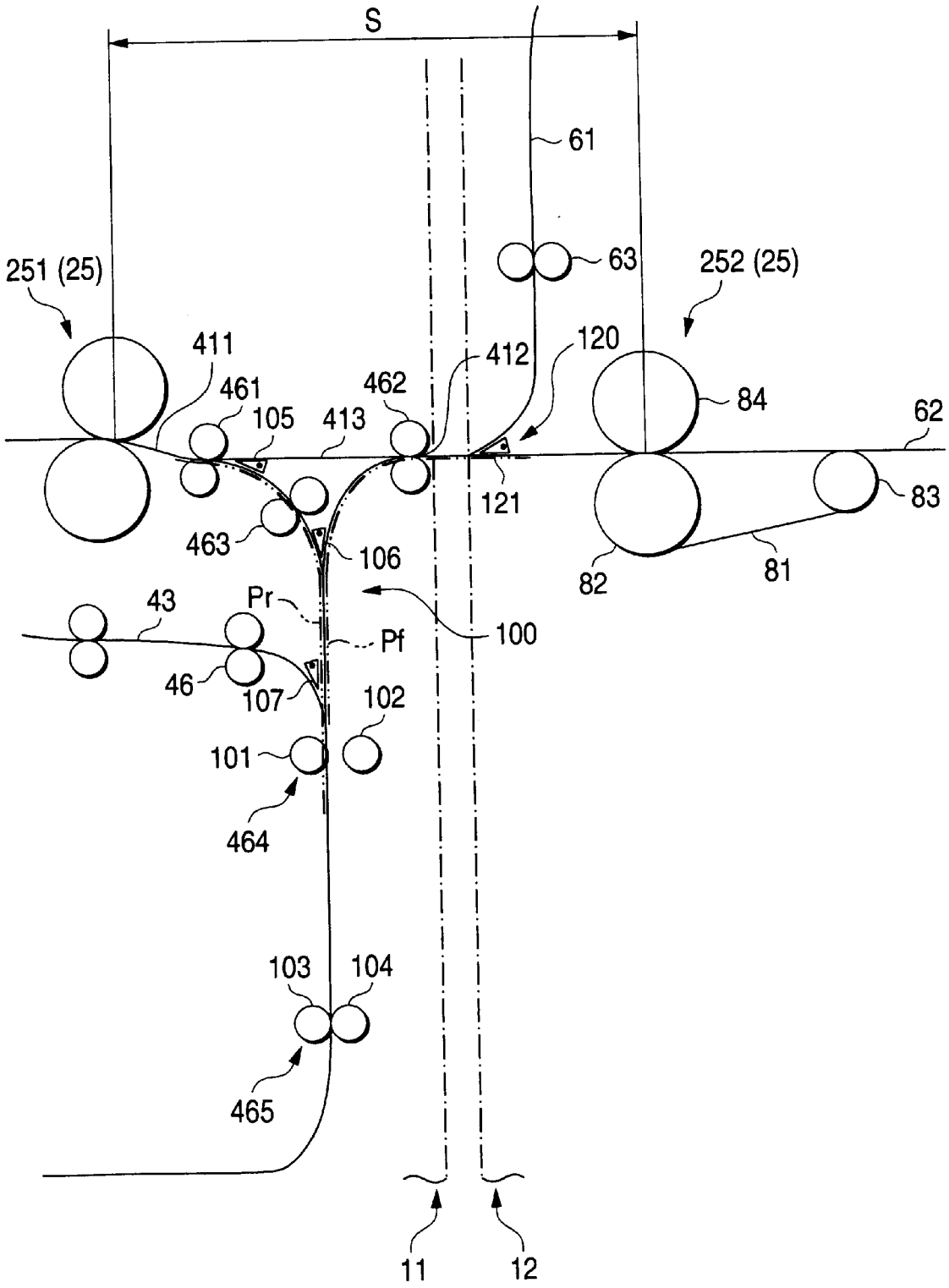
FIG. 7 is an explanatory diagram showing an example of transporting operation of a recording material in both-side recording mode and one-side recording mode of the image forming apparatus according to the embodiment 2.

To be more specific, when the image forming apparatus operates in a mode in which the secondary fixing device 252 is used, the recording material having passed through the primary fixing device 251, as shown in FIGS. 6 and 7, is reversed and transported by the recording material reversing/transporting mechanism 100, and then is fed to the secondary fixing device 252.

In the embodiment, the primary fixing device 251 is similar in construction to that in the embodiment 1, and fixes the toner image on the recording material at the fixing speed v1, for example.

On the other hand, in the secondary fixing device 252, as shown in FIG. 7 in particular, the fixing belt 81 (stretched on the heat fuser roll 82 and the peeling roll 83) and the pressing roll 84 are reversely disposed as vertically viewed, since the image surface of the recording material to be subjected to the secondary fixing process is reversed by the recording material reversing/transporting mechanism 100. The secondary fixing device executes a fixing process at a fixing speed v2, which is slower than the fixing speed v1 (v1>v2).

Next, operations of the image forming apparatus according to this embodiment will be described.

In the following description on each of recording modes, it is assumed that a case is similar to that in the embodiment 1.

A. Both-Side Recording Mode

The image forming apparatus is operated as shown in FIG. 9C. An image is recorded on the front surface of a recording material by the image forming module 21. The primary fixing device 251 fixes the image on the recording material at the fixing speed v1, the recording material reversing/transporting mechanism 100 of the reversing path 42 reverses the recording material, and feeds the recording material to the returning path 43. Thereafter, the recording material is returned from the returning path 43 to the main transporting path 41, via the select gate. An image is recorded on the rear surface of the recording material by the image forming module 21. Thereafter, it is passed through the primary fixing device 251 at the fixing speed v1; the recording material is reversed by the recording material reversing/transporting mechanism 100; the recording material is passed through the secondary fixing device 252 at the fixing speed v2; and the recording material having undergone the fixing process is ejected to the lower ejection tray 52.

Thus, in the embodiment, the fixing speed v1 of the primary fixing device 251 is higher than the fixing speed v2 of the secondary fixing device 252. Therefore, the productivity of recording the image on the recording material can be improved and the fixing property of the rear surface image (high image quality) on the recording material can be kept in high level.

The recording material reversed by the recording material reversing/transporting mechanism 100 is transported into the secondary fixing device 252. With this feature, even if a span S between the primary fixing device 251 and the secondary fixing device 252 is shorter than the transporting length of the recording material as viewed in the recording material transporting direction, the recording material is never transported while the recording material is extending over the fixing devices 251 and 252. Further, the primary and secondary fixing processes are carried out while being free from the fixing speed difference between the fixing devices 251 and 252.

Further more, if the first reversing roll 464 is set to be released from the nipping state at a time when the preceding recording material Pf is nipped by the entrance/exit roll 462, as indicated by a phantom line in FIG. 7, the subsequent recording material Pr can be pulled to the reversing path 42. As a result, the preceding recording material Pf and the subsequent recording material Pr can cross each other in the switchback path 423.

By so doing, the image quality can be kept at high quality without reducing the productivity of the machine when the image forming apparatus is in the both-side recording mode (standard mode).

B. One-Side Recording Mode

B-1. Standard Mode

When the image forming apparatus is in the one-side recording mode and the standard mode, its operation is similar to that in the embodiment 1. Specifically, as shown in FIG. 10C, the image forming module 21 records an image on one side of the recording material; the primary fixing device 251 primarily fuses and fixes the toner image on the recording material; and the recording material bearing the fixed image travels along the first transporting path 61 and is discharged into the upper ejection tray 51.

B-2. High Image Quality Mode

When the image forming apparatus is in the one-side recording mode and in the high image quality mode, the image forming apparatus operates as shown in FIG. 10C. The image forming module 21 records an image on one side of the recording material; the recording material passes through the primary fixing device 251 at the fixing speed v1; the recording material reversing/transporting mechanism 100 reverses the recording material; the recording material passes through the secondary fixing device 252 at the fixing speed v2; and the recording material having the fixed image is ejected to the lower ejection tray 52.

In this case, as well as the rear surface image recording process in the both-side recording mode, the fixing speed v1 of the primary fixing device 251 is selected to be fast, and the fixing speed v2 of the secondary fixing device 252 is selected to be slow. Accordingly, the productivity of the one-side high image quality recording on the recording material can be improved and further the fixing property of the image on the recording material (image having the high image quality) can be kept well.

<Embodiment 3>

Figure 8:
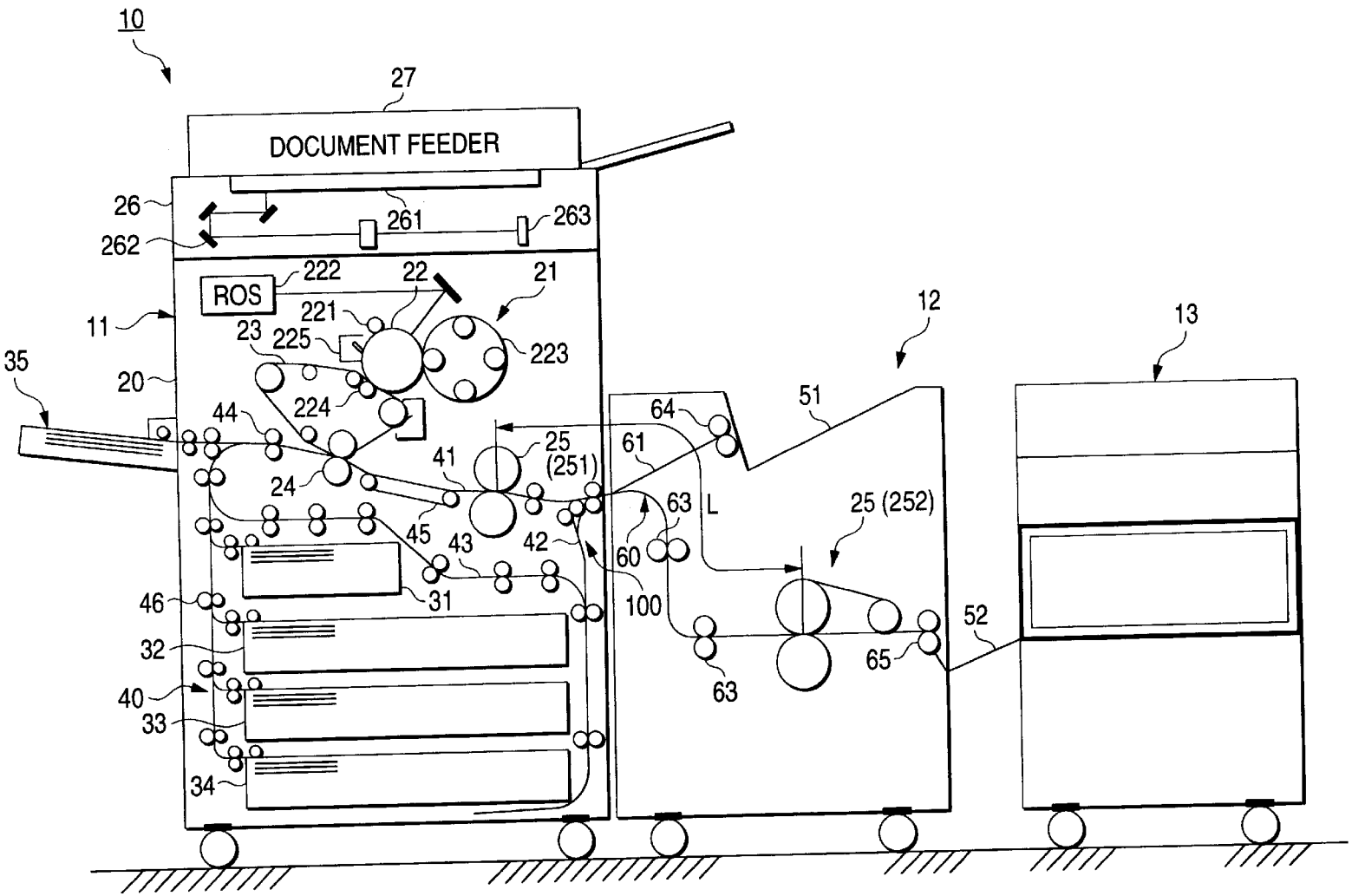
FIG. 8 is an explanatory diagram showing an outline of an image forming apparatus according to an embodiment 3.

FIG. 8 shows an image forming apparatus according to the embodiment 3 to which the invention is applied.

In the figure, in the image forming apparatus according to this embodiment, the fixing speed of the primary fixing device 251 of the fixing device 25 is different from that of the secondary fixing device 252, as well as the embodiment 2. However, means for absorbing the difference in the fixing speed between the fixing devices 251 and 252 is different from that in the embodiment 2. It is noted that like or equivalent portions are designated by the same reference numerals and detailed explanation therefor is omitted.

In the embodiment, a length of the transporting path between the primary fixing device 251 and the secondary fixing device 252 is set to be longer than the maximum length L of the recording material in the transporting direction. The secondary fixing device 252 is disposed as well as the embodiment 1, different from the embodiment 2.

In this embodiment, when the image forming apparatus is in the both-side recording mode, as shown in FIG. 9C, the image forming module 21 records an image on the recording material; the image is primarily fixed on the recording material by the primary fixing device 251 at the fixing speed v1; the recording material reversing/transporting mechanism 100 of the reversing path 42 reverses the recording material having the fixed image; and the resultant recording material is returned to the returning path 43. Thereafter, the recording material is returned to the main transporting path 41 through the returning path 43 and the select gate (not shown); the image forming module 21 forms an image on the rear surface of the recording material; the recording material having the image is transported to pass through the primary fixing device 251 at the fixing speed v1, and then pass through the secondary fixing device 252 at the fixing speed v2; and the resultant recording material is discharged to the lower ejection tray 52.

The operation of the image forming apparatus when the image forming apparatus is in the one-side recording mode and in the standard mode is similar to that in the embodiment 1. In this case, as shown FIG. 10C, the image forming module 21 forms an image on one side of the recording material; the primary fixing device 251 primarily fuses and fixes the image onto the recording material; and the recording material having the fixed image is ejected into the upper ejection tray 51 through the first transporting path 61 of the fixing unit 12.

On the other hand, when the image forming apparatus is in the one-side recording mode and in the high image quality mode, as shown in FIG. 10C, the image forming module 21 forms an image on one side of the recording material; the primary fixing device 251 fuses and fixes the image on the recording material at the fixing speed v1; the secondary fixing device 252 fuses and fixes the image on the recording material at the fixing speed v2; and the recording material having the fixed image is ejected into the lower ejection tray 52.

During such an operation process, the rear end of the recording material leaves the primary fixing device 251 and then the leading edge of the recording material reaches the secondary fixing device 252 since the transporting path length L between the primary fixing device 251 and the secondary fixing device 252 is set to be sufficiently long. Accordingly, it never happens that the recording material is transported while the recording material is extending over the fixing devices 251 and 252. Further, the primary and secondary fixing processes are carried out while being free from the fixing speed difference between the fixing devices 251 and 252.

A post processing unit 13, such as a cutter or the like, may additionally be provided at the post stage of the fixing unit 12.

As seen from the foregoing description, the fixing device includes the primary fixing device and the secondary fixing device. In operation, an image is recorded on the front surface of the recording material, and the recording material having the image formed is transported to pass through only the primary fixing device. Subsequently, an image is formed on the rear surface of the recording material and the recording material having the image formed is transported to pass through the primary fixing device and the secondary fixing device. Accordingly, if, for example, the image forming apparatus is set to form an image having the high image quality as an image recorded on the rear surface of the recording material, an image having the high image quality can be obtained without reducing the productivity in the both-side recording mode.

In another embodiment, the fixing device includes the primary fixing device and the secondary fixing device. Further, additionally includes a primary ejection path which ejects the recording material having passed through the primary fixing device and a secondary ejection path which ejects the recording material having passed through the primary fixing device and the secondary fixing device sequentially. Accordingly, the recording material which is required only the primary fixing by the primary fixing device can be ejected through the primary ejection path quickly. On the other hand, the recording material which is required the fixing process in two steps by the both fixing devices can be ejected through the secondary ejection path.

Thus, the image quality and the productivity both can be improved in accordance with a mode (e.g., the standard mode, high image quality mode, and the like) of using the recording material.

What is claimed is:

1. An image forming apparatus comprising:

an image forming module for forming images on both sides of a recording material sequentially;

a primary fixing device disposed in a recording material transporting path;

a secondary fixing device disposed downstream of the primary fixing device, wherein the primary and secondary fixing devices fix the images on the both sides of the recording material, and the recording material is passed through only the primary fixing device after a first image is recorded on a front surface of the recording material, a second image is recorded on a rear surface of the recording material, and subsequently, the recording material is passed through the primary fixing device and the secondary fixing device;

a preceding recording material and a subsequent recording material are transported in a reversing path to cross each other;

an image forming unit including the primary fixing device; and a fixing unit including the secondary fixing device, the fixing unit being separate from the image forming unit, wherein the fixing unit further comprises:

a primary ejection path for ejecting the recording material after the recording material passes through the primary fixing device, and a secondary ejection path for ejecting the recording material after the recording material passes through the primary fixing device and subsequently passes through the secondary device.

2. The image forming apparatus according to claim 1, wherein the primary fixing device is set a primary fixing condition in which an image is fixed so as not to peel off the recording material as the recording material passes through a transporting path; and the secondary fixing device is set a secondary fixing condition in which an image is sufficiently fixed to the recording material.

3. The image forming apparatus according to claim 1, wherein said image forming module forms a monochromatic image on the front surface of the recording material and forms a color image on the rear surface of the recording material.

4. The image forming apparatus according to claim 1, wherein a transporting path between the primary fixing device and the secondary fixing device is the reversing path where the recording material is reversed.

5. The image forming apparatus according to claim 1, wherein a transporting path between the primary fixing device and the secondary fixing device is formed so that a leading end of the recording material reaches the secondary fixing device after a rear end of the recording material leaves the primary fixing device.

6. The image forming apparatus according to claim 1, wherein under a condition in which the recording material passes through the primary fixing device and then passes through the secondary fixing device, a fixing speed of the primary fixing device is set to be equal to that of the secondary fixing device.

7. An image forming apparatus comprising:

an image forming module for forming images on both sides of a recording material sequentially;

a primary fixing device disposed in a recording material transporting path; and a secondary fixing device disposed downstream of the primary fixing device;

wherein the primary and secondary fixing devices fix the images on the both sides of the recording material, and the fixing device includes a primary ejection path for ejecting the recording material having passed through the primary fixing device and a secondary ejection path for ejecting the recording material having passed through the primary fixing device and the secondary fixing device in this order;

a preceding recording material and a subsequent recording material are transported in a reversing path to cross each other; an image forming unit including the primary fixing device; and a fixing unit including the secondary fixing device, the fixing unit being separate from the image forming unit, wherein the fixing unit further includes the primary ejection path, and the secondary ejection path.

8. The image forming apparatus according to claim 2, wherein the primary fixing device is set a primary fixing condition in which an image is sufficiently fixed to the recording material under a standard condition in which a use condition of the recording material is standard; and the secondary fixing device is set a second fixing condition in which an image is sufficiently fixed to the recording material under a particular condition in which a use condition of the recording material is particular.

9. The image forming apparatus according to claim 2, wherein the secondary fixing device includes a fixing belt and a pressure roll.

10. The image forming apparatus according to claim 9, further comprising a cooling unit disposed in the fixing belt.

11. The image forming apparatus according to claim 7, further comprising a select unit for selecting one of the primary ejection path and the secondary ejection path in accordance with a use condition of the recording material.

12. The image forming apparatus according to claim 7, wherein a fixing speed of the secondary fixing device is set to be slower than that of the primary fixing device.

13. The image forming apparatus according to claim 9, wherein a transporting path between the primary fixing device and the secondary fixing device is a reversing path where the recording material is reversed.

14. The image forming apparatus according to claim 7, wherein a transporting path between the primary fixing device and the secondary fixing device is formed so that a leading end of the recording material reaches the secondary fixing device after a rear end of the recording material leaves the primary fixing device.

15. The image forming apparatus according to claim 7, wherein under a condition in which the recording material passes through the primary fixing device and then passes through the secondary fixing device, a fixing speed of the primary fixing device is set to be equal to that of the secondary fixing device.

16. An image forming module for forming images on both sides of a recording material sequentially;

a fixing device for fixing the images on both sides of the recording material, wherein the fixing device includes a primary fixing device disposed in a recording material transporting path and a secondary fixing device disposed downstream of the primary fixing device, and the recording material is passed through only the primary fixing device after an image is recorded on a front surface of the recording material, an image is recorded on a rear surface of the recording material, and subsequently, the recording material is passed through the primary fixing device and the secondary fixing device; and a preceding recording material and a subsequent recording material are a reversing path to cross each other.

17. An image forming apparatus comprising:

an image forming module for forming images on both sides of a recording material sequentially;

a fixing device for fixing the images on both sides of the recording material, wherein the fixing device includes a primary fixing device disposed in a recording material transporting path and a secondary fixing device disposed downstream of primary fixing device, and the fixing device includes a primary ejection path for ejecting the recording material having passed through the primary fixing device and a secondary ejection path for ejecting the recording material having passed through the primary fixing device and the secondary fixing device in this order; and a preceding recording material and a subsequent recording material are transported in a reversing path to cross each other.

* * * * *